US007938698B1

(12) United States Patent
Yu

(10) Patent No.: US 7,938,698 B1
(45) Date of Patent: May 10, 2011

(54) ELECTRICAL CONNECTOR

(75) Inventor: Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/963,615

(22) Filed: Dec. 8, 2010

(51) Int. Cl.
*H01R 4/48* (2006.01)

(52) U.S. Cl. ..... 439/862

(58) Field of Classification Search ..... 439/78, 439/66, 862, 79
See application file for complete search history.

(56) References Cited

U.S. PATENT DOCUMENTS 6,273,731 B1 * 8/2001 Bishop et al. ..... 439/66
6,315,620 B1 * 11/2001 Moir et al. ..... 439/862
6,896,557 B2 * 5/2005 Aekins et al. ..... 439/676
6,951,488 B2 * 10/2005 Hsieh ..... 439/660
6,994,566 B2 * 2/2006 You ..... 439/66
7,011,555 B2 * 3/2006 Pan ..... 439/862
7,410,390 B2 * 8/2008 Watanabe et al. ..... 439/607.01
7,632,153 B1 * 12/2009 Lai et al. ..... 439/660
7,682,172 B2 * 3/2010 Lu ..... 439/181

* cited by examiner

*Primary Examiner* — Briggitte R Hammond

(57) ABSTRACT

An electrical connector is mounted to a printed circuit board which has two buckling elements mounted thereon. The electrical connector includes an inner insulating housing, an outer insulating housing, a shell surrounding the inner insulating housing, and a plurality of conductive terminals. The outer insulating housing has an accommodating cavity for receiving the shell and the inner insulating housing. The outer insulating housing has a top wall. A top surface of the top wall defines a plurality of receiving passages. The outer insulating housing is mounted by the two buckling elements to make the electrical connector assembled under the printed circuit board with the top wall thereof abutting against the printed circuit board. Touching portions of the conductive terminals electrically contact the printed circuit board and are further pressed into the corresponding receiving passages by the printed circuit board.

7 Claims, 6 Drawing Sheets

ELECTRICAL CONNECTOR

BACKGROUND OF THE INVENTION

1. Field of the Invention

The present invention relates to an electrical connector, and more particularly to an electrical connector capable of being mounted to a printed circuit board swiftly.

2. The Related Art

Referring to FIG. 7, a traditional electrical connector 80 generally includes an insulating housing 81, a plurality of terminals 82 and a shell 83. The insulating housing 81 defines a plurality of terminal grooves 811. Each of the terminals 82 has a soldering arm 821. The terminals 82 are assembled in the terminal grooves 811 of the insulating housing 81. The shell 83 surrounds the insulating housing 81 to enclose the terminals 82 thereamong. The soldering arms 821 are projected out from the insulating housing 81 for being soldered to a printed circuit board (not shown).

However, it will take much time for soldering the soldering arms 821 to the printed circuit board (not shown), and working time of mounting the electrical connector 80 to the printed circuit board is prolonged accordingly. As a result, the manufacturing efficiency is lower, and manufacturing cost is higher.

SUMMARY OF THE INVENTION

An object of the present invention is to provide an electrical connector for being mounted to a printed circuit board which has two buckling elements mounted thereon and spaced from each other. The electrical connector includes an inner insulating housing, an outer insulating housing, a shell and a plurality of conductive terminals. The inner insulating housing has a base body and a tongue portion protruded forward from a front of the base body. A bottom of the base body defines a fastening groove extending vertically and further to penetrate through a rear of the base body. The outer insulating housing has a bottom wall, two side walls, and a top wall which are interconnected to define an accommodating cavity thereamong. A top surface of the top wall defines a plurality of receiving passages spaced from one another and each extends longitudinally to penetrate through a rear edge of the top wall. A shell is looped from a metal plate and surrounds the inner insulating housing. The shell together with the inner insulating housing is inserted in the accommodating cavity of the outer insulating housing. Each conductive terminal has a substantially L-shaped connecting portion of which one arm is fastened in the inner insulating housing and the other arm is located behind the base body, the shell and the top wall. A top end of the other arm of the connecting portion extends forward and is inclined upward to form an elastic portion partially received the receiving passage. A free end of the elastic portion is arched upward to form a touching portion projecting out of the receiving passage. The outer insulating housing is mounted by the two buckling elements to make the electrical connector assembled under the printed circuit board with the top wall abutting against the printed circuit board, the touching portions of the conductive terminals electrically contact the printed circuit board and are further pressed into the corresponding receiving passages by the printed circuit board.

As described above, the electrical connector is mounted to the printed circuit board by means of buckling buckling blocks of the outer insulating housing in buckling grooves of the buckling elements with the touching portions of the conductive terminals and a touching end of a ground terminal electrically abutting against the printed circuit board so as to make the electrical connector assembled to the printed circuit board swiftly. So there is a decreased working time to mount the electrical connector to the printed circuit board. As a result, the manufacturing efficiency is improved, and the manufacturing cost is lower.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
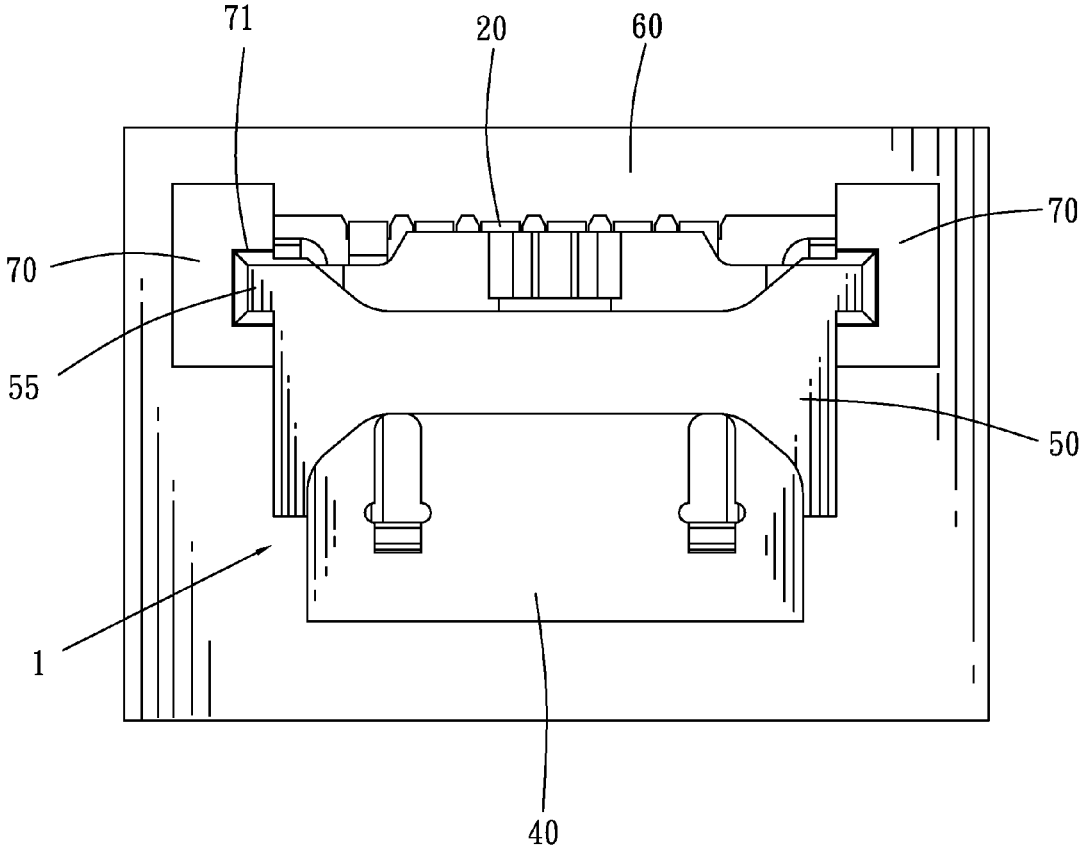
FIG. 1 is a vertical view of an electrical connector mounted to a printed circuit board which has two buckling elements mounted thereon according to the present invention.
Figure 2:
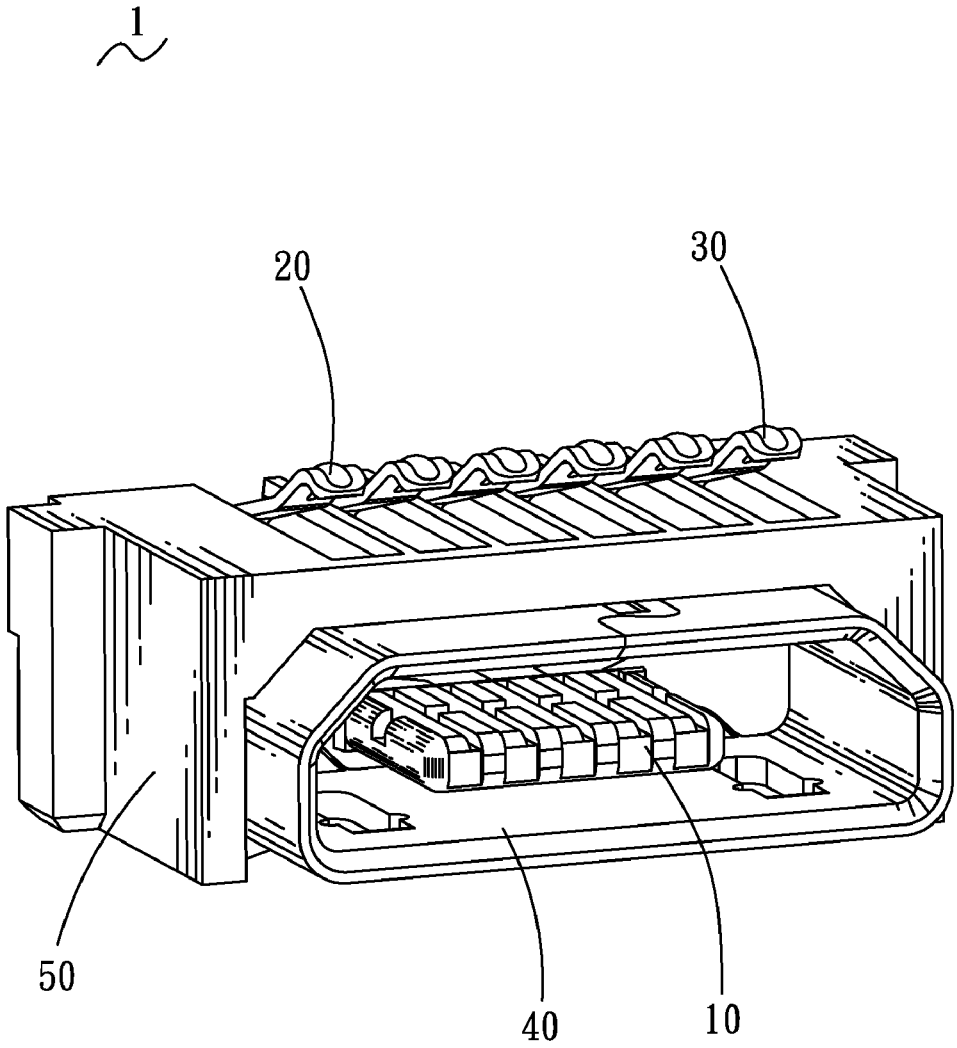
FIG. 2 is a perspective view of an electrical connector shown in FIG. 1.

Referring to FIG. 1 and FIG. 2, an electrical connector 1 is adapted for being mounted to a printed circuit board 60. The electrical connector 1 includes an inner insulating housing 10, a plurality of conductive terminals 20, a ground terminal 30, a shell 40 and an outer insulating housing 50.

Figure 3:
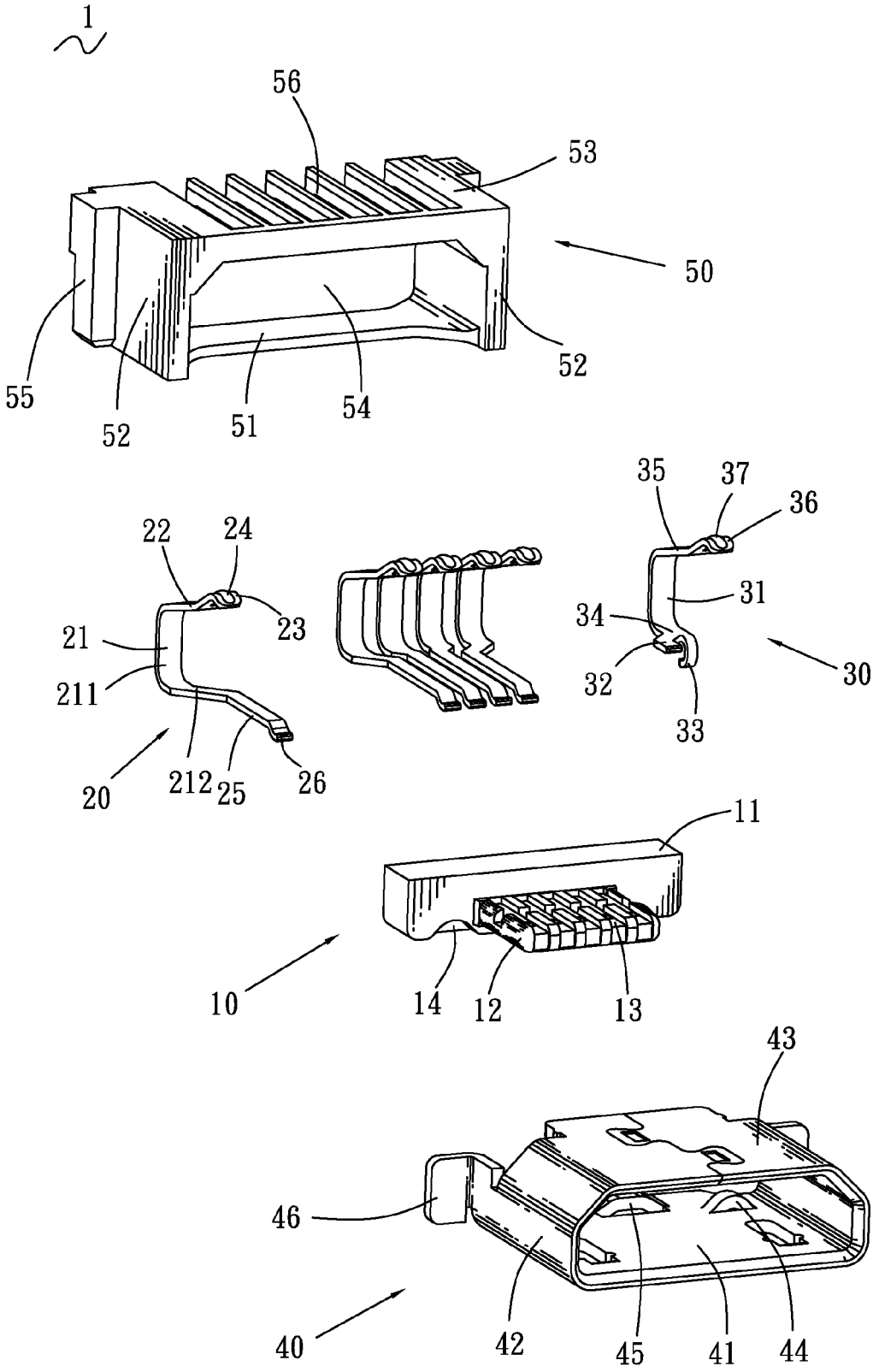
FIG. 3 is an exploded view of the electrical connector of FIG. 2.
Figure 4:
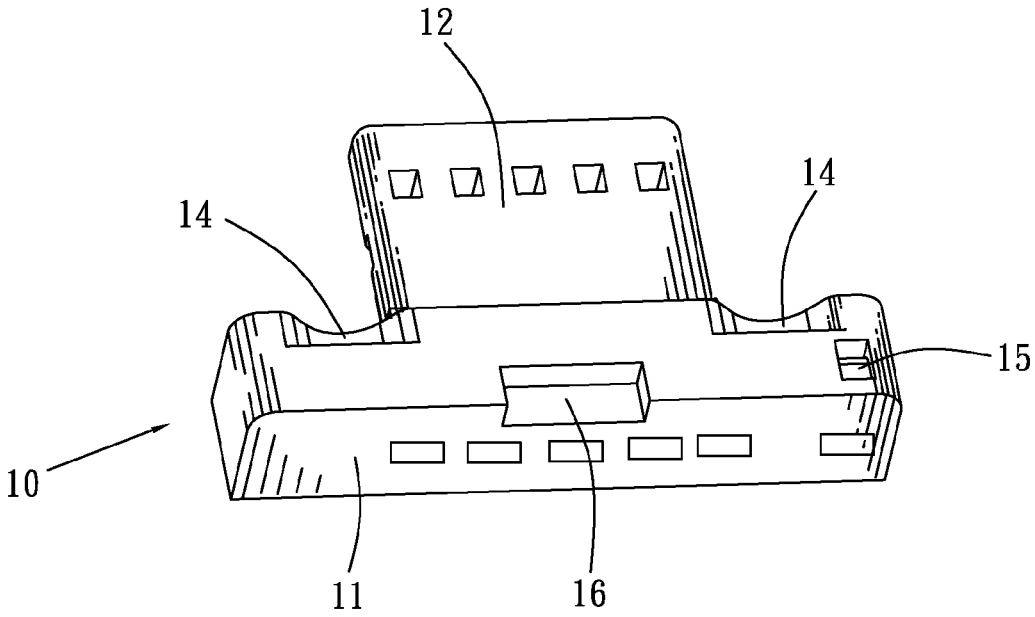
FIG. 4 is a perspective view of an insulating housing of the electrical connector of FIG. 2.
Figure 5:
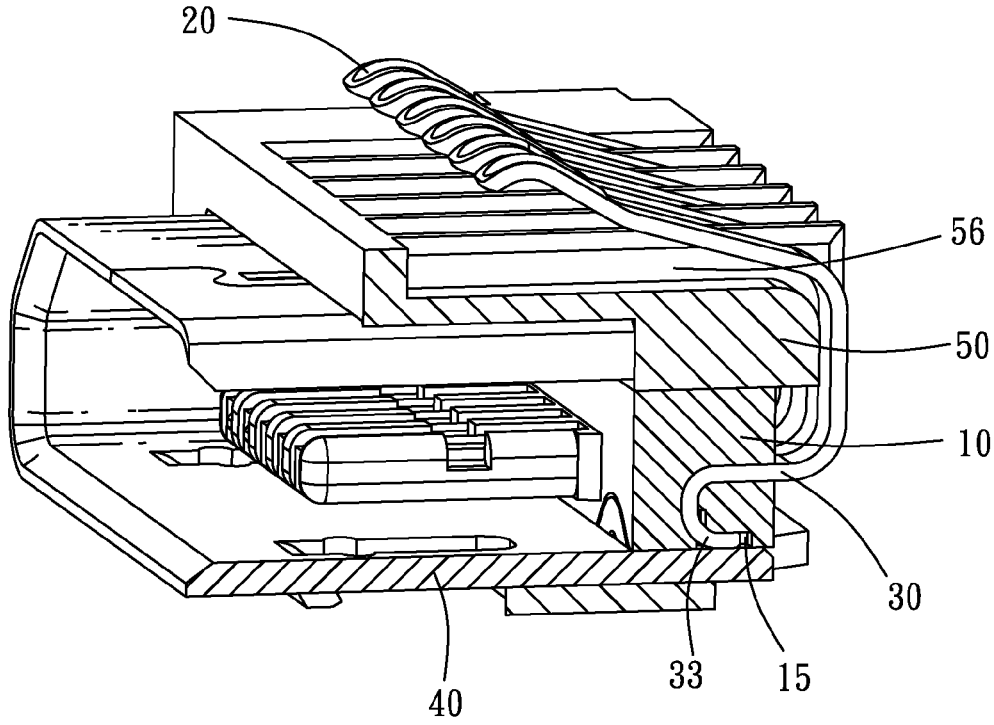
FIG. 5 is a sectional view of the electrical connector of FIG. 2.

Referring to FIG. 3 and FIG. 4, the inner insulating housing 10 has a base body 11 and a tongue portion 12 protruded forward from a middle of a front of the base body 11. A top of the tongue portion 12 defines a plurality of terminal grooves 13 longitudinally extending to further penetrate through the base body 11. One end of a bottom of the base body 11 defines a fastening groove 15 of substantial lying-U shape with an upper groove penetrating through a rear side of the base body 11 and a lower groove exposed out of the bottom of the base body 11. Two bottom portions of a front side of the base body 11 are recessed rearward to form two recesses 14 penetrating through the bottom of the base body 11 and adjacent to two opposite sides of the tongue portion 12, respectively. A bottom edge of a rear side of the base body 11 defines a clipping groove 16.

Referring to FIG. 3, the conductive terminal 20 has a substantially L-shaped connecting portion 21 which has a first arm 211 and a second arm 212 substantially perpendicular to the first arm 211. The first arm 211 is disposed vertically, and a top end of the first arm 211 of the connecting portion 21 extends forward and is inclined upward to form an elastic portion 22. A free end of the elastic portion 22 is arched upward to form a touching portion 23. A top surface of the touching portion 23 is protruded upward to form a conductive touching point 24. A front end of the second arm 212 of the connecting portion 21 extends forward to form a contacting portion 25. A free end of the contacting portion 25 is curved downward to form a buckling portion 26.

Referring to FIG. 3, the ground terminal 30 has an elongated base arm 31. One end of the base arm 31 is bent forward to form a connecting arm 34. A portion of a side edge of the connecting arm 34 protrudes sideward to form a fastening arm 32. A substantially U-shaped contacting arm 33 with the mouth facing rearward is connected with a free end of the connecting arm 34. The other end of the base arm 31 extends forward and is inclined upward to form an elastic arm 35. A free end of the elastic arm 35 is arched upward to form a touching end 36. A top surface of the touching end 36 is protruded upward to form a ground touching point 37.

Referring to FIG. 3, the shell 40 is made of a metal plate and has a bottom plate 41. Two opposite sides of the bottom plate 41 extend upward to form two side plates 42. Two top sides of the two side plates 42 are slightly inclined towards each other and then extend toward each other to form two top plates 43 engaged with each other. Two portions of a rear of a top of the bottom plate 41 protrude upward to form two fastening protrusions 44 spaced from each other. A middle of a rear of the bottom plate 41 protrudes upward to form a clipping protrusion 45 at a rear of the fastening protrusions 44. Two rear ends of the two side plates 42 oppositely extend outward to form two blocking plates 46.

Referring to FIG. 3 again, the outer insulating housing 50 has a bottom wall 51, two side walls 52 extending upward from two opposite sides of the bottom wall 51, and a top wall 53 connecting with the two side walls 52. The bottom wall 51, the two side walls 52 and the top wall 53 are interconnected to define an accommodating cavity 54 thereamong. A top surface of the top wall 53 of the outer insulating housing 50 defines a plurality of receiving passages 56 spaced from one another along a transverse direction thereof and each extending longitudinally to penetrate through a rear edge. A rear end of the receiving passage 56 further extends downward to pass through a rear end surface of the top wall 53. Two rears of the two side walls 52 oppositely protrude outward to form two buckling blocks 55.

Referring to FIGS. 2-5, when the electrical connector 1 is assembled, the conductive terminals 20 and the ground terminal 30 are molded integrally with the inner insulating housing 10. The second arm 212 of the connecting portion 21 and the contacting arm 25 are secured in the terminal grooves 13 and the contacting portion 25 is further exposed from the top of the tongue portion 12, and the first arm 211 of the connecting portion 21 is located behind the base body 11. The buckling portion 26 is embedded in the tongue portion 12. The connecting arm 34, the contacting arm 33 and the fastening arms 32 are secured in the fastening groove 15, and the base arm 31 is located behind the base body 11. The shell 40 surrounds the inner insulating housing 10 with the first arm 211, the elastic portions 22, the touching portions 23, the base arm 31, the elastic arm 35 and the touching end 36 being projected out of the inner insulating housing 10 and the shell 40. A lower arm of the contacting arm 33 is exposed out from the lower groove of the fastening groove 15 to abut against an inside of the shell 40 for avoiding static electricity. The fastening protrusions 44 are received in the recesses 14 respectively and the clipping protrusion 45 is blocked in the clipping groove 16 to secure the inner insulating housing 10 in the shell 40. The inner insulating housing 10 together with the shell 40 is inserted into the accommodating cavity 54 of the outer insulating housing 50 from rear to front. The first arms 211 of the connecting portions 21 of the conductive terminals 20 and the base arm 31 of the ground terminal 30 are received in the receiving passages 56 at a vertical direction. Rears of the elastic portions 22 and a rear of the elastic arm 35 are received in rear ends of the receiving passages 56 at a horizontal direction. Fronts of the elastic portions 22 and the touching portions 23 of the conductive terminals 20, and a front of the elastic arm 35 and the touching end 36 of the ground terminal 30 project upward out of the corresponding receiving passages 56. The blocking plates 46 are blocked by rear ends of the two side walls 52 of the outer insulating housing 50.

Figure 6:
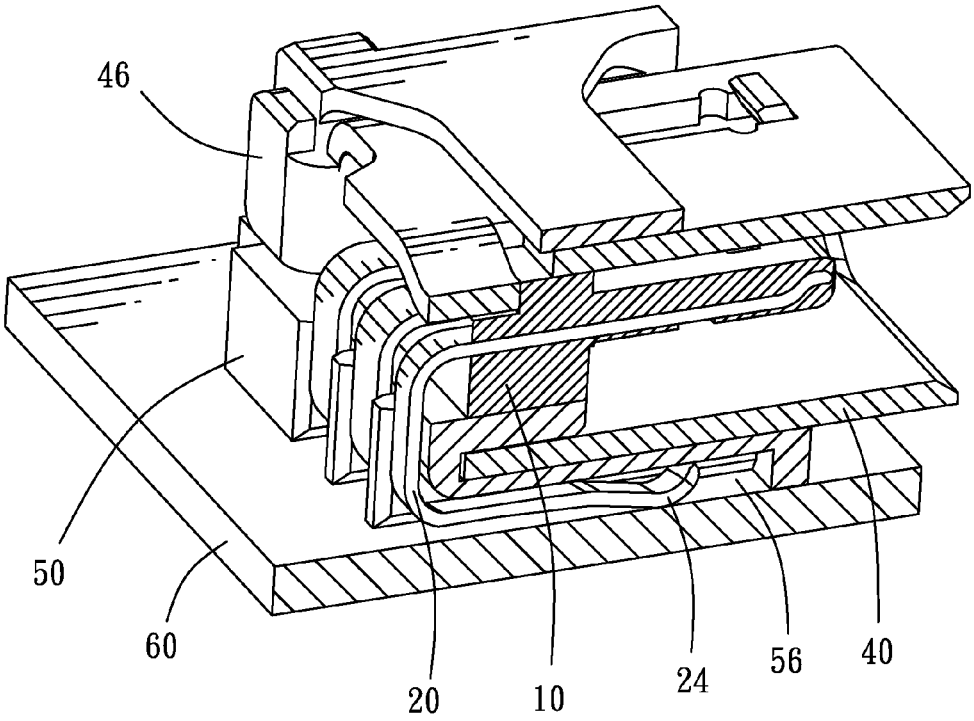
FIG. 6 is a sectional view of the electrical connector mounted to the printed circuit board of FIG. 1.
Figure 7:
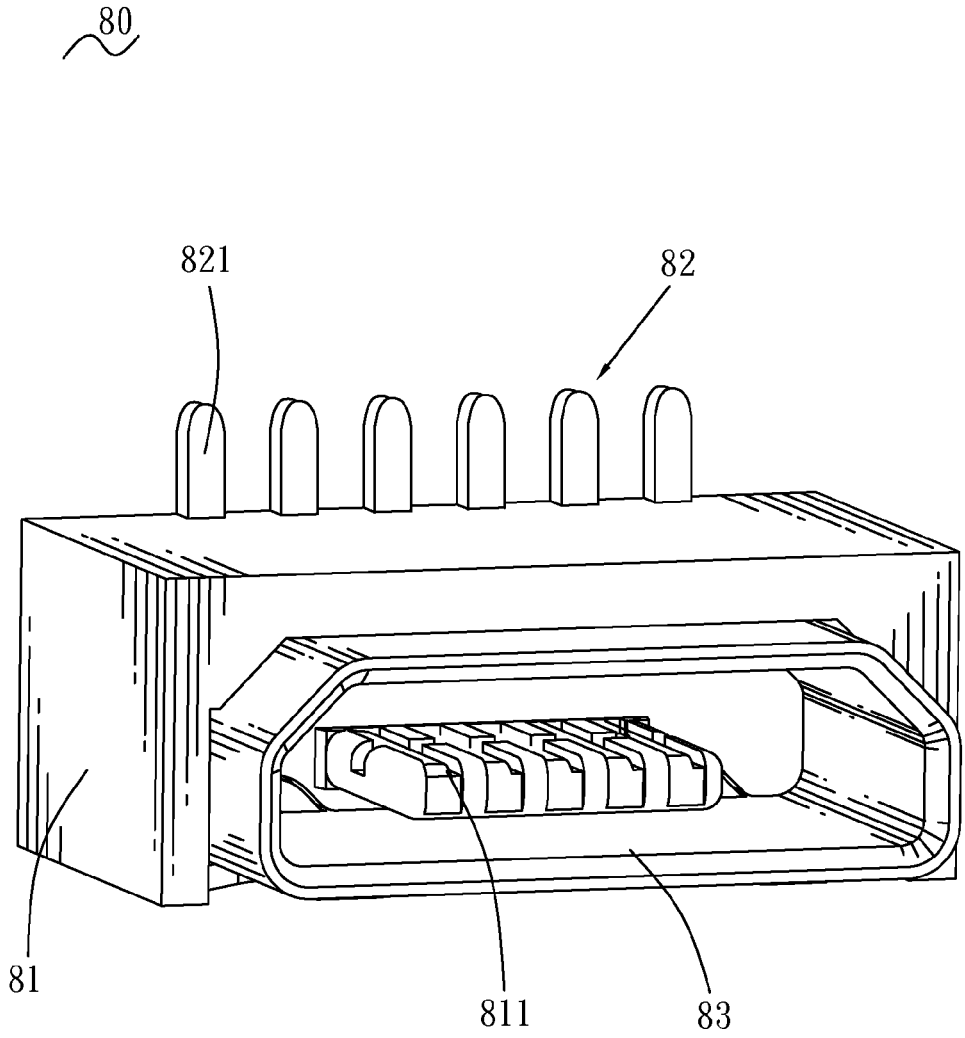
FIG. 7 (Related Art)
FIG. 7 is a perspective view of a traditional electrical connector.

Referring to FIG. 1, FIG. 3 and FIG. 6, the electrical connector 1 is mounted to the printed circuit board 60 which has two buckling elements 70 mounted thereon and spaced from each other. Each of the buckling elements 70 defines a buckling groove 71 at a side thereof facing another buckling element 70 for buckling the buckling block 55 of the outer insulating housing 50 therein to make the electrical connector 1 assembled under the printed circuit board 60 with the top wall 53 abutting against the printed circuit board 60. The conductive touching points 24 of the touching portions 23 of the conductive terminals 20 and the ground touching points 37 of the touching end 36 of the ground terminal 30 electrically contact the printed circuit board 60 and the touching portions 23 and the touching end 36 are further pressed into the corresponding receiving passages 56 by the printed circuit board 60. So that an electrical connection between the electrical connector 1 and the printed circuit board 60, and a ground function of the electrical connector 1 are realized.

As described above, the electrical connector 1 is mounted to the printed circuit board 60 by means of buckling the buckling blocks 55 of the outer insulating housing 50 in the buckling grooves 71 of the buckling elements 70 with the conductive touching points 24 of the touching portions 23 of the conductive terminals 20 and the ground touching point 37 of the touching end 36 of the ground terminal 30 electrically abutting against the printed circuit board 60 so as to make the electrical connector 1 assembled to the printed circuit board 60 swiftly. So there is a decreased working time to mount the electrical connector 1 to the printed circuit board 60. As a result, the manufacturing efficiency is improved, and the manufacturing cost is lower.

What is claimed is:

1. An electrical connector for being mounted to a printed circuit board which has two buckling elements mounted thereon and spaced from each other, comprising:

an inner insulating housing having a base body and a tongue portion protruded forward from a front of the base body;

an outer insulating housing having a bottom wall, two side walls and a top wall which are interconnected to define an accommodating cavity thereamong, a top surface of the top wall defining a plurality of receiving passages spaced from one another and each extending longitudinally to penetrate through a rear edge of the top wall;

a shell looped from a metal plate and surrounding the inner insulating housing, the shell together with the inner insulating housing being inserted in the accommodating cavity of the outer insulating housing; and a plurality of conductive terminals each having a substantially L-shaped connecting portion of which one arm is fastened in the inner insulating housing and the other arm is located behind the base body, the shell and the top wall, a top end of the other arm of the connecting portion extending forward and being inclined upward to form an elastic portion partially received the receiving passage, a free end of the elastic portion being arched upward to form a touching portion projecting out of the receiving passage, wherein the outer insulating housing is mounted by the two buckling elements to make the electrical connector assembled under the printed circuit board with the top wall abutting against the printed circuit board, the touching portions of the conductive terminals electrically contact the printed circuit board and are further pressed into the corresponding receiving passages by the printed circuit board.

2. The electrical connector as claimed in claim 1, wherein each of the buckling elements defines a buckling groove at a side thereof facing another buckling element, the two side walls of the outer insulating housing oppositely protrude outward to form two buckling blocks buckled in the buckling grooves of the buckling elements respectively.

3. The electrical connector as claimed in claim 1, wherein the shell has two side plates, two rear ends of the two side plates oppositely extend outward to form two blocking plates blocked by rear ends of the two side walls of the outer insulating housing.

4. The electrical connector as claimed in claim 1, wherein the shell has a bottom plate, a rear of a top of the bottom plate defines two fastening protrusions spaced from each other and a clipping protrusion located at a rear of the fastening protrusions, two ends of a front side of the base body have two bottom portions recessed upward to form two recesses, a bottom edge of a rear side of the base body defines a clipping groove, the fastening protrusions are received in the recesses respectively and the clipping protrusion is blocked in the clipping groove to secure the inner insulating housing in the shell.

5. The electrical connector as claimed in claim 1, wherein a top of the tongue portion defines a plurality of terminal grooves each extending longitudinally to further penetrate through the base body of the inner insulating housing, a front end of the one arm of the connecting portion extends forward to form a contacting portion, the one arm of the connecting portion and the contacting portion are secured in the corresponding terminal groove and the contacting portion is further exposed from the top of the tongue portion.

6. The electrical connector as claimed in claim 5, wherein a free end of the contacting portion is curved downward to form a buckling portion embedded in the tongue portion.

7. The electrical connector as claimed in claim 1, further comprising a ground terminal which has a base arm, a contacting arm and an elastic arm connected at two opposite ends of the base arm, the contacting arm being of substantial U-shape with the mouth facing rearward and the elastic arm being inclined upward with a free end thereof arched upward to form a touching end, a bottom of the base body defining a fastening groove of substantial lying-U shape with an upper groove penetrating through a rear side of the base body and a lower groove exposed out of the bottom of the base body, the contacting arm being secured in the fastening groove with the lower arm thereof exposed out to abut against an inside of the shell, the base arm being located behind the base body and the top wall, the elastic arm being received in the corresponding receiving passage and the touching end being pressed into the receiving passage by the printed circuit board.

* * * * *